US008862006B2

(12) United States Patent
Hirai

(10) Patent No.: US 8,862,006 B2
(45) Date of Patent: Oct. 14, 2014

(54) WET-TYPE IMAGE FORMING APPARATUS THAT CONTROLS THE AMOUNT OF LIQUID DEVELOPER BASED ON THE RATE OF CHANGE OF THE ELECTRIC POTENTIAL OF THE LIQUID DEVELOPER

(75) Inventor: Atsuto Hirai, Ikoma (JP)

(73) Assignee: Konica Minolta Holdings, Inc., Tokyo (JP)

( * ) Notice: Subject to any disclaimer, the term of this patent is extended or adjusted under 35 U.S.C. 154(b) by 104 days.

(21) Appl. No.: 13/417,927

(22) Filed: Mar. 12, 2012

(65) Prior Publication Data

US 2012/0237237 A1 Sep. 20, 2012

(30) Foreign Application Priority Data

Mar. 18, 2011 (JP) ..... 2011-060983

(51) Int. Cl.
*G03G 15/10* (2006.01)

(52) U.S. Cl.
CPC ..... *G03G 15/10* (2013.01); *G03G 15/105* (2013.01); *G03G 2215/0658* (2013.01)
USPC ..... 399/57; 399/237; 399/240

(58) Field of Classification Search
USPC ..... 399/57
See application file for complete search history.

(56) References Cited

U.S. PATENT DOCUMENTS

| | | | | |
|---|---|---|---|---|
| 6,253,040 | B1 * | 6/2001 | Kopp et al. | 399/55 |
| 7,970,300 | B2 * | 6/2011 | Tabata et al. | 399/45 |
| 8,116,641 | B2 * | 2/2012 | Soutome | 399/27 |
| 8,660,449 | B2 * | 2/2014 | Momotani et al. | 399/58 |
| 8,682,223 | B2 * | 3/2014 | Momotani | 399/239 |
| 2006/0078343 | A1 * | 4/2006 | Shin et al. | 399/57 |
| 2006/0110186 | A1 * | 5/2006 | Hirai | 399/237 |
| 2006/0153585 | A1 * | 7/2006 | Shin et al. | 399/57 |
| 2008/0069579 | A1 * | 3/2008 | Tabata et al. | 399/53 |
| 2010/0040387 | A1 * | 2/2010 | Hirai | 399/45 |

(Continued)

FOREIGN PATENT DOCUMENTS

| | | |
|---|---|---|
| JP | 58-121050 A | 7/1983 |
| JP | 2000-214688 | 8/2000 |

(Continued)

OTHER PUBLICATIONS

Japanese Office Action regarding corresponding Japanese patent application 2011-060983 mailed Jul. 8, 2014 including translation.

*Primary Examiner* — David Gray
*Assistant Examiner* — Geoffrey Evans
(74) *Attorney, Agent, or Firm* — Brinks Gilson & Lione

(57) ABSTRACT

A wet-type image forming apparatus forms a toner image on an image carrier using liquid developer containing carrier liquid and toner dispersed therein. The apparatus includes: a developing member carrying the liquid developer to develop a latent image thereby forming the toner image on the image carrier; a charger for charging the liquid developer on the developing member according to a current applied on the charger; a measuring member for measuring a potential of the liquid developer charged by the charger; and a controller for controlling an amount of the liquid developer on the developing member, before the toner image is formed on the image carrier, by setting plural values of the current to be applied on the charger and controlling the amount of the liquid developer based on results of measurement of potentials of the liquid developer charged by the charger with the plural values of the applied current.

9 Claims, 12 Drawing Sheets

(56) References Cited

U.S. PATENT DOCUMENTS

| | | | | |
|---|---|---|---|---|
| 2010/0226687 | A1* | 9/2010 | Fukazawa | 399/240 |
| 2011/0064432 | A1* | 3/2011 | Horike et al. | 399/44 |
| 2012/0201555 | A1* | 8/2012 | Nishiyama et al. | 399/55 |
| 2013/0101304 | A1* | 4/2013 | Sasaki et al. | 399/49 |

FOREIGN PATENT DOCUMENTS

| | | | |
|---|---|---|---|
| JP | 2005/234430 | A | 9/2005 |
| JP | 2005-258386 | A | 9/2005 |
| JP | 2009-294490 | | 12/2009 |
| JP | 2010-014892 | | 1/2010 |

* cited by examiner

WET-TYPE IMAGE FORMING APPARATUS THAT CONTROLS THE AMOUNT OF LIQUID DEVELOPER BASED ON THE RATE OF CHANGE OF THE ELECTRIC POTENTIAL OF THE LIQUID DEVELOPER

This application is based on Japanese Patent Application No. 2011-060983 filed with the Japan Patent Office on Mar. 18, 2011, the entire content of which is hereby incorporated by reference.

BACKGROUND OF THE INVENTION

1. Field of the Invention

The present invention relates to an electrophotographic image forming apparatus such as a copier, a printer, and a facsimile, and particularly to a wet-type image forming apparatus using liquid developer to form a toner image.

2. Description of the Related Art

In an electrophotographic image forming apparatus, toner supplied from a developing device is used to develop an electrostatic image on a photoconductor. Then, the developed toner image is transferred onto a recording paper, whereby an image is formed on the recording paper. In the transfer process in such an image forming apparatus, an electrostatic transfer technique is generally adopted.

When a toner image is transferred onto recording paper serving as a transfer target, voltage is applied by a transfer roller from the back side of the recording paper conveyed to a position opposing the photoconductor to form an electric field between the photoconductor and the recording paper. The electric field causes the toner image to be electrostatically adsorbed on the recording paper.

Thereafter, the toner image formed on the recording paper is heated and pressed by a fixing device, whereby the transferred toner image is fixed on the recording paper.

On the other hand, in recent years, in an image forming apparatus such as an office printer for bulk printing and an on-demand printer that requires higher image quality and higher resolution, a wet-type developing device is known, which uses a liquid developer with a small toner particle size that is less likely to produce toner image noise. The liquid developer is prepared by dispersing toner in a carrier liquid such as a paraffin-based solvent. In the development and transfer process, toner is moved by the effect of an electric field in a toner layer containing the carrier liquid and the toner, whereby an image is transferred onto recording paper.

In order to obtain high-quality images in the wet-type developing device, it is necessary to transfer images at an appropriate image density. In this case, the image density is determined by the amount of toner on the developing roller. Therefore, it is important to stably control a thin layer of liquid developer (toner layer thickness) on the developing roller.

The liquid developer thin layer (toner layer thickness) varies with a change in viscosity of the liquid developer due to a temperature change, an error of the apparatus, and the like. Thus, it becomes necessary to sense and control the amount of the liquid developer thin layer.

Japanese Laid-Open Patent Publication No. 2010-014892 discloses a method of sensing a surface potential of a developing roller and controlling the amount of a liquid developer thin layer such that the surface potential is constant.

Here, the toner charged by a charger has a potential as a result of charge, and its surface potential (toner layer potential) is determined by the toner charge amount and the amount of adhered toner. Therefore, when the toner charge amount is constant, the amount of adhered toner on the developing roller can be found by measuring the surface potential (toner layer potential).

In order to keep the toner charge amount constant, the flow-in current from the charger for charging should be kept constant. In order to do so, it is necessary to measure the current flowing into the developing roller from the charger and to control the current at a constant value.

However, in actuality, not only the current from the charger but also the current flowing between the developing roller and the photoconductor and the like flows into the developing roller. Therefore, it is difficult to measure only the flow-in current from the charger.

There is another problem that even when current flowing from the power supply to the charger is controlled to be constant, stains on the charger, an environmental change, and the like change the current flowing into the developing roller.

If the surface potential (toner layer potential) is measured in this state and the amount of adhered toner is calculated, the measured amount of toner adhesion differs from the actual amount, because the toner charge amount is also changed due to variations of the flow-in current. Therefore, the amount of the liquid developer thin layer cannot be controlled accurately.

SUMMARY OF THE INVENTION

The present invention is made to solve the aforementioned problem. An object of the present invention is to provide a wet-type image forming apparatus capable of accurately controlling the amount of the liquid developer thin layer.

A wet-type image forming apparatus according to an aspect of the present invention forms a toner image on an image carrier using liquid developer containing carrier liquid and toner dispersed therein. The apparatus includes: a developing member configured to carry the liquid developer to develop a latent image thereby forming the toner image on the image carrier; a charger configured to charge the liquid developer on the developing member according to a current applied on the charger; a measuring member configured to measure an electric potential of the liquid developer charged by the charger; and a controller configured to control an amount of the liquid developer on the developing member, before the toner image is formed on the image carrier, by setting plural values of the current to be applied on the charger and controlling the amount of the liquid developer based on results of measurement by the measuring member of electric potentials of the liquid developer charged by the charger with the plural values of the applied current.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
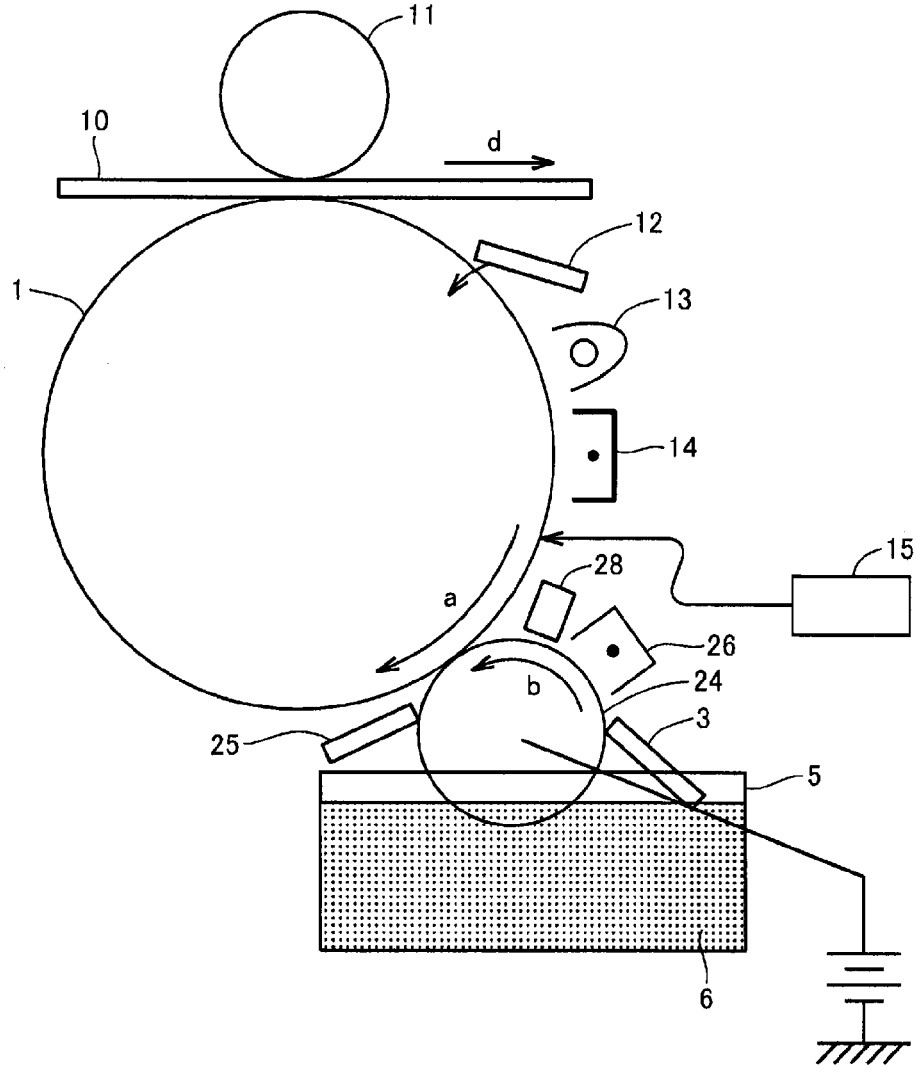
FIG. 1 is a schematic configuration diagram showing an example of a wet-type image forming apparatus according to a first embodiment of the present invention.

In the following, embodiments of the present invention will be described with reference to the figures. In the following description, the same parts and components are denoted with the same reference numerals. Their names and functions are also the same.

In the embodiments of the present invention, a wet-type image forming apparatus is described representatively as an example of image forming apparatuses. However, the present invention is similarly applicable to a dry-type image forming apparatus.

First Embodiment

Using FIG. 1, an example of a wet-type image forming apparatus according to a first embodiment of the present invention will be described.

Referring to FIG. 1, a wet-type image forming apparatus according to the first embodiment of the present invention includes a photoconductor 1 serving as a drum-like image carrier. On the periphery of photoconductor 1, disposed are a developing roller 24 serving as a developing device, a transfer roller 11, a cleaning blade 12, an eraser lamp 13, a charger 14, and an exposing device 15, in order in the rotational direction shown by the arrow a.

The surface of photoconductor 1 is uniformly charged by charger 14 to a prescribed surface potential. Thereafter, exposure of image information is performed by exposing device 15 so that an electrostatic latent image is formed on the surface of photoconductor 1. Then, the electrostatic latent image on photoconductor 1 is developed with a liquid developer including toner particles and carrier liquid by developing roller 24 of the developing device, whereby a toner image is formed on the surface of photoconductor 1. Here, not only the toner particles but also the carrier liquid that is a dispersion medium is also adhered on the surface of photoconductor 1.

Then, the toner image formed on the surface of photoconductor 1 is conveyed to a transfer portion that is opposed to transfer roller 11. Then, at the transfer portion, a transfer target 10 is conveyed in the direction of the arrow (direction d), and the toner particles on photoconductor 1 are transferred onto transfer target 10 under the force of voltage applied to transfer roller 11 with a polarity opposite to that of the toner particles. Transfer target 10 having the toner particles transferred thereon is conveyed to a not-shown fixing unit, so that the toner image is fixed.

On the other hand, cleaning blade 12 is provided on the surface of photoconductor 1 passing through the transfer portion to recover the transfer residual toner particles and the carrier liquid as a dispersion medium left on photoconductor 1. Photoconductor 1, from which the toner particles and the dispersion medium have been recovered, is exposed by eraser lamp 13, so that the latent image potential is cancelled. These steps are repeatedly performed to successively print images.

Here, the main components of the liquid developer are insulative liquid serving as a carrier liquid, toner particles for developing a static latent image, and a dispersant for dispersing the toner particles in the carrier liquid.

Any carrier liquid that is generally used for a liquid developer for electrophotography can be used. Examples of the carrier liquid include isoparaffin-based ISOPAR (G, H, L, M, and so on) (Exxon Mobil Corporation), IP Solvent (1620, 2028, 2835, and so on) (Idemitsu Kosan Co., Ltd.), and paraffin-based MORESCO-WHITE (P-40, P-70, P-120) (MATSUMURA OIL Co., Ltd.). Silicon oil and mineral oil may be used.

The toner particles are mainly formed of resin and pigment or dye for coloring. The resin has a function of dispersing the pigment or dye evenly in the resin and a function as a binder during fixing on recording paper.

Any toner particle that is generally used in a liquid developer for electrophotography can be used. Examples of the resin for toner may include thermoplastic resins such as polystyrene resins, styrene acrylic resins, acrylic resins, polyester resins, epoxy resins, polyamide resins, polyimide resins, and polyurethane resins. More than one kind of these resins may be mixed for use.

Commercially available pigment and dye may be used to color the toner. Examples of the pigment may include carbon black, iron red, titanium oxide, silica, phtalocyanine blue, phtalocyanine green, sky blue, benzidine yellow, and lake red D. Examples of the dye may include Solvent Red 27 and Acid Blue 9.

The liquid developer can be prepared based on the generally used technique. For example, resin and pigment blended at a prescribed ratio are molten and kneaded to be dispersed evenly using a pressure kneader, a roller mill, or the like. The resultant dispersive product is finely ground, for example, by a jet mill. The resultant fine particles are classified, for example, by a wind classifier to obtain colored toner with a desired particle size. Then, the resultant toner particles and insulative liquid serving as a carrier liquid are mixed at a prescribed ratio. The mixture is evenly dispersed by dispersing means such as a ball mill, resulting in a liquid developer.

The mean particle size of toner may be 0.1 μm to 5 μm as the wet-type image forming technique is adopted. The particle size less than 0.1 μm considerably reduces developing performance, whereas the particle size greater than 5 μm reduces image quality. Therefore, it is desired to set the size to 0.1 to 5 μm.

The appropriate proportion of toner particles to the entire mass of the liquid developer (TC ratio) is 10 to 50%.

If less than 10%, sedimentation of toner particles is likely to occur, which is a problem in terms of stability over time during long-term storage. In addition, a large amount of liquid developer has to be supplied to achieve the required image density. This increases the amount of carrier liquid adhered to recording paper and thus requires treatment of vapor produced in drying during fixing. On the other hand, if exceeding 50%, the viscosity of liquid developer is too high, which may make it difficult to handle during production.

The viscosity of the liquid developer is desirably 0.1 mPa·s or more and 10000 mPa·s or less at 25° C. If greater than 10000 mPa·s, the handling such as stirring and feeding of the liquid developer becomes difficult, and the load on a device supplying the liquid developer evenly may be increased. If smaller than 0.1 mPa·s, the control of the amount of toner on the developing roller becomes difficult, which makes it difficult to realize an appropriate image density.

An overall configuration of the developing device according to the first embodiment of the present invention will now be described briefly.

The developing device includes developing roller 24 brought into pressure-contact with photoconductor 1, and a developer tank 5 storing liquid developer 6 including toner and carrier liquid. Developing roller 24 is partially soaked in developer tank 5. In this example, developing roller 24 rotates in the rotational direction b, and photoconductor 1 rotates in the rotational direction a.

On the periphery of developing roller 24, provided are a regulating member 3 for regulating the thickness of liquid developer to achieve the desired amount of toner adhesion, a charger 26, a surface potential sensor 28, and a cleaning blade 25 for removing the left liquid developer.

Developing roller 24 is supplied with the liquid developer which is regulated to a prescribed amount by regulating member 3. Charge is applied by charger 26 to the toner included in the liquid developer on developing roller 24. Thereafter, the charged toner is conveyed to photoconductor 1 by developing roller 24, and an electrostatic latent image is developed on photoconductor 1.

Surface potential sensor 28 is provided to be opposed to the surface of developing roller 24 at a nip portion (development portion) between charger 26, developing roller 24, and photoconductor 1. Surface potential sensor 28 can measure the surface potential of the toner layer after the toner particles in liquid developer 6 are charged by charger 26.

After the toner particles are charged, liquid developer 6 is conveyed to a development portion to come into contact with photoconductor 1.

Using FIG. 2, a state of the development portion according to the first embodiment of the present invention will be described.

Figure 2:
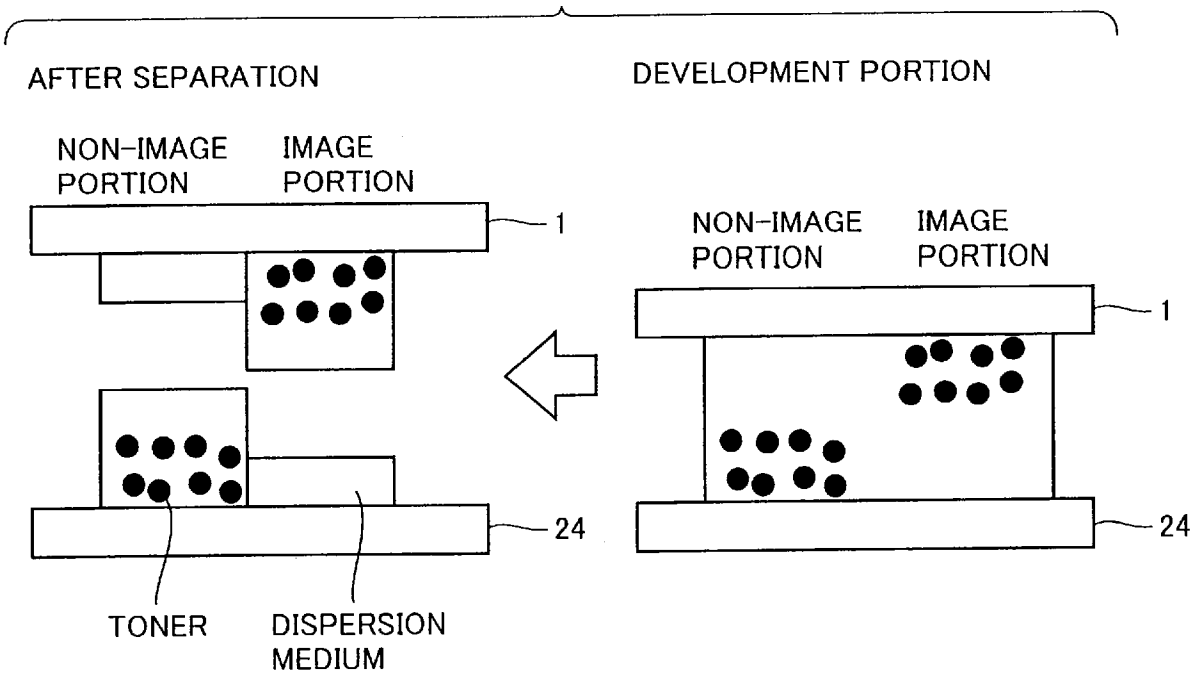
FIG. 2 illustrates a state of a development portion according to the first embodiment of the present invention.

Referring to FIG. 2, an electrostatic latent image having the same polarity as the toner particles is formed on the surface of photoconductor 1 conveyed to the development portion according to the first embodiment of the present invention. The potential of an image portion of the electrostatic latent image is low, whereas the potential of a non-image portion is high.

A potential between the potential at the image portion and the potential at the non-image portion is applied to developing roller 24. At the development portion, the toner particles at the image portion move to the surface of photoconductor 1, and the toner particles at the non-image portion move to the surface of developing roller 24, because of the potential difference. Thereafter, photoconductor 1 and developing roller 24 are separated from each other, so that liquid developer 6 is divided into photoconductor 1 and developing roller 24. As a result, the toner particles and the dispersion medium adhere to the image portion on photoconductor 1 while only the dispersion medium adheres to the non-image portion thereof. Conversely, only the dispersion medium adheres to a place on developing roller 24 corresponding to the image portion of photoconductor 1 while the toner particles and the dispersion medium are present on a place corresponding to the non-image portion.

When new liquid developer 6 is supplied to developing roller 24 in this state, an area with a different toner density appears on developing roller 24 corresponding to the previous image. As a result, the toner density of the next image formed becomes uneven. In order to prevent this state, cleaning blade 25 is provided on developing roller 24 to clean all the toner particles and the dispersion medium after development and to recover them into developer tank 5.

Means for sensing the toner density (not shown) is provided in developer tank 5 since the toner density of liquid developer 6 passing through the development portion differs from the original density. The means for sensing the toner density may be optical means or may be such means that obtains the toner density based on torque for stirring liquid developer 6. In response to a signal from the sensing means, developer tank 5 is replenished with condensed developer or dispersion medium so that the toner density of liquid developer 6 is kept constant. In addition, though not shown, means for sensing the amount of liquid developer 6 and means for stirring liquid developer 6 are additionally provided in developer tank 5.

A conductive film or a charging roller may be used as charger 26. Although an example of direct transfer from the photoconductor to paper has been illustrated, an intermediate transfer unit may be used. A development belt may be used in place of the developing roller.

The rollers are each shaped like a cylinder and shown in cross-section in this example.

Cleaning blade 25 may be a rubber or rigid body. Examples of the rubber body include urethane rubber, NBR rubber, and fluorine rubber. Examples of the rigid body include resins such as polypropylene, ABS, and polycarbonate, and metals such as aluminum, alumite, SUS, and brass.

A method of regulating the thickness of liquid developer will now be described.

Using FIG. 3, adjustment of regulating member 3 according to the first embodiment of the present invention will be described.

Figure 3:
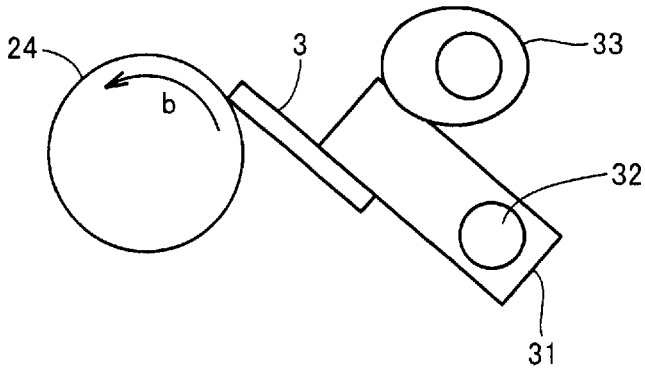
FIG. 3 illustrates adjustment of a regulating member 3 according to the first embodiment of the present invention.

Referring to FIG. 3, a blade is provided as regulating member 3 for regulating the layer thickness of liquid developer 6 in abutment with developing roller 24.

Regulating member 3 is held by a holding member 31. Holding member 31 is installed so as to be rotatable around a rotation shaft 32.

An eccentric cam 33 is in abutment with holding member 31. Rotation of eccentric cam 33 allows holding member 31 to rotate around rotation shaft 32, so that the abutment force of regulating member 3 on developing roller 24 is changed.

When the abutment force of regulating member 3 is changed, the layer thickness of liquid developer 6 that is allowed to pass through between regulating member 3 and developing roller 24 is changed. That is, the amount of liquid developer can be adjusted.

Using FIG. 4, functional blocks for controlling the wet-type image forming apparatus according to the first embodiment of the present invention will be described.

Figure 4:
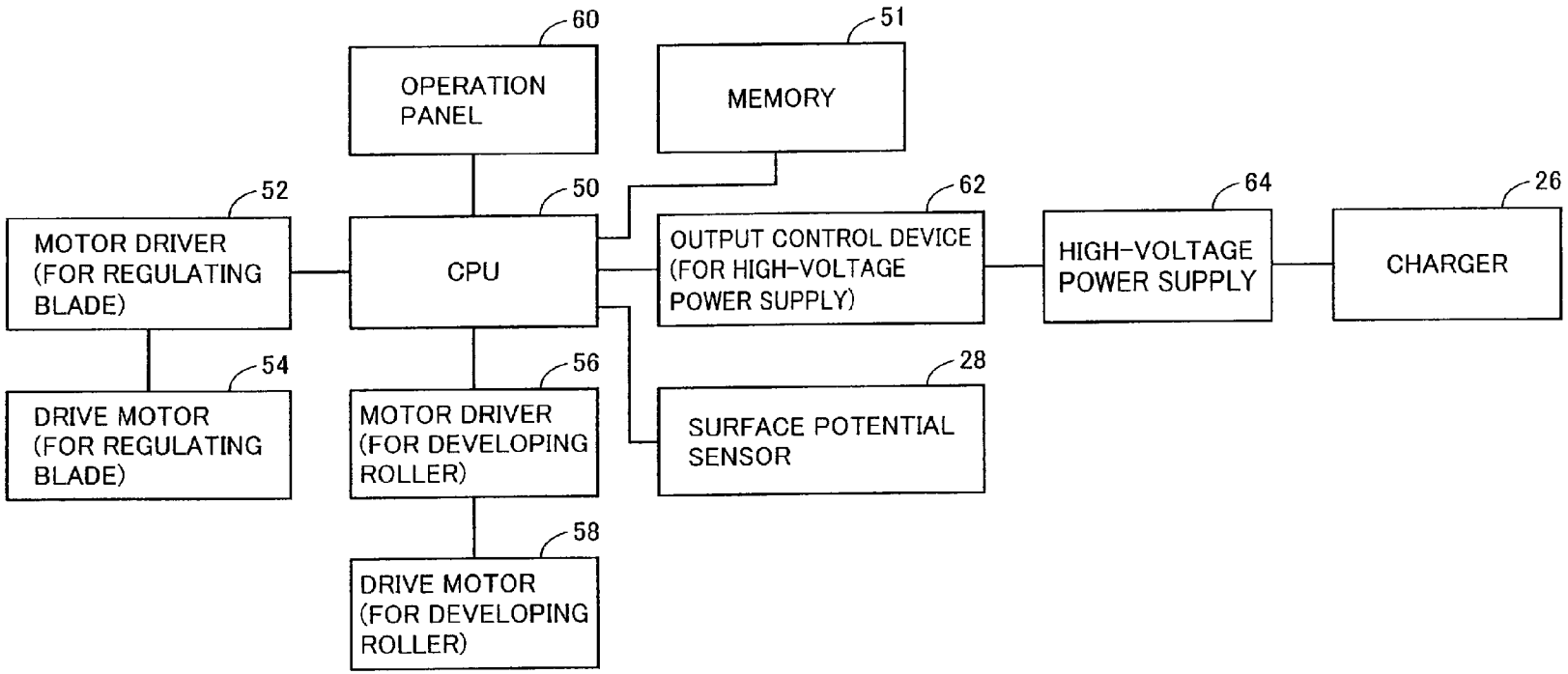
FIG. 4 illustrates functional blocks for controlling the wet-type image forming apparatus according to the first embodiment of the present invention.

Referring to FIG. 4, provided are a CPU (Central Processing Unit) 50 serving as control means for controlling the wet-type image forming apparatus of the first embodiment of the present invention as a whole, a memory 51, an operation panel 60, a motor driver 52, a drive motor 54, an output control device 62, a high-voltage power supply 64, charger 26, surface potential sensor 28, a motor driver 56, and a drive motor 58, by way of example.

Operation panel 60 is connected to CPU 50 to designate, for example, execution of an image forming operation according to an instruction through user's operation on operation panel 60 and to control each unit of CPU 50. A program necessary for CPU 50 to control each unit is stored beforehand in memory 51. CPU 50 reads the control program to execute desired processing. A control program for executing a flow described later is also stored in memory 51. Data such as graphs described later is also stored in memory 51 so that CPU 50 uses the data as necessary.

CPU 50 is connected to motor driver 52 for driving drive motor 54 for bringing the regulating blade into pressure-contact to control motor driver 52. Motor driver 52 drives drive motor 54 for bringing the regulating blade into pressure-contact according to an instruction from CPU 50.

CPU 50 is connected to motor driver 56 for driving drive motor 58 for driving developing roller 24 to control motor driver 56. Motor driver 56 drives drive motor 58 according to an instruction from CPU 50. Drive motor 58 drives developing roller 24.

Output control device 62 for controlling output from high-voltage power supply 64 for the charger is connected to high-voltage power supply 64 to control high-voltage power supply 64 according to an instruction from CPU 50.

Output control device 62 controls high-voltage power supply 64 to output a high-voltage power supply to charger 26.

Surface potential sensor 28 is connected to CPU 50 to output to CPU 50 the measured surface potential of toner particles in the liquid developer on developing roller 24.

The principle of calculating the amount of adhered toner of the liquid developer on developing roller 24 will now be described.

Using FIG. 5, a configuration of a measuring device for measuring the surface potential of toner particles of the liquid developer according to an embodiment of the present invention will be described. This device is experimental equipment for obtaining the mutual relationship between the flow-in current, the toner layer potential, the amount of adhered toner, and the like. The device includes a roller 71, and a charger 72 and a surface potential sensor 73 on the periphery of roller 71. Since photoconductor 1 is not in contact with developing roller 24 as in FIG. 1, the only flow-in current to developing roller 71 is the current output from charger 72. No current flows between developing roller 24 and photoconductor 1 as in the device in FIG. 1 configured such that developing roller 24 and photoconductor 1 are in contact with each other.

Figure 5:
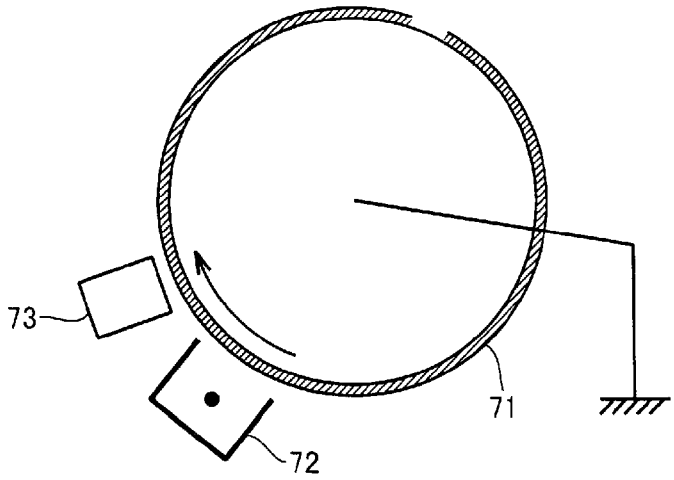
FIG. 5 illustrates a configuration of a measuring device for measuring a surface potential of toner particles of liquid developer according to an embodiment of the present invention.

Roller 71, charger 72, and surface potential sensor 73 in FIG. 5 correspond to developing roller 24, charger 26, and surface potential sensor 28 in FIG. 1, respectively.

Roller 71 is a metal roller having a diameter of 100 mm and a width of 100 mm. Roller 71 is grounded.

A thin layer of a certain amount of liquid developer is formed on the surface of roller 71 by a bar coater or the like. A liquid developer with a toner density of 30% is used, by way of example. Toner particles in the amount corresponding to the layer thickness of liquid developer are present on roller 71.

Then, while current is fed from charger 72 (effective width 80 mm), roller 71 makes one rotation at 420 mm/sec.

A constant-current power supply is connected to charger 72 so that current flowing into roller 71 is under constant-current control.

Surface potential sensor 73 measures the surface potential (toner layer potential) of toner particles of the liquid developer charged by charger 72.

Using FIG. 6, the measurement result in the measuring device according to the embodiment of the present invention will be described.

Figure 6:
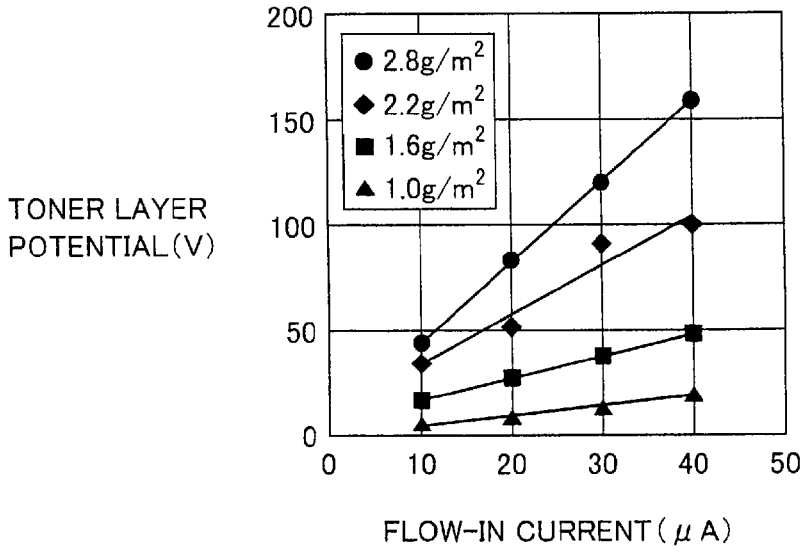
FIG. 6 illustrates a measurement result in the measuring device according to the embodiment of the present invention.

Referring to FIG. 6, the result shown here is obtained by measuring the surface potentials (toner layer potential) of toner particles of the liquid developer in roller 71 while changing the layer thickness of the liquid developer, that is, the amount of toner particle adhesion, and the current flowing from charger 72 to roller 71.

As shown here, there is correlation between the flow-in current from charger 72 to roller 71 and the surface potential (toner layer potential) of toner particles of the liquid developer. In addition, the surface potential (toner layer potential) of toner particles of the liquid developer varies according to the layer thickness (the amount of adhered toner) of the liquid developer.

Therefore, in the case where current flowing from charger 27 is only the current flowing into developing roller 24, if the value of the flow-in current to developing roller 24 is known, the toner layer thickness (the amount of adhered toner) can be calculated by measuring the surface potential (toner layer potential) of toner particles of the liquid developer at that flow-in current.

However, in the actual system, current not only flows into developing roller 24 from charger 27 but also flows at the development portion with photoconductor 1. Therefore, it is difficult to measure only the flow-in current from charger 27.

Furthermore, even if a constant current is supplied from the high-voltage power supply, current actually flowing into developing roller 24 changes due to the environment or stains on the charger, which makes it difficult to precisely grasp the value of the flow-in current shown in the figure. Supposing that, given a certain flow-in current, the toner layer thickness (the amount of adhered toner) is calculated from the surface potential (toner layer potential) of toner particles of the liquid developer, an error may occur in the result.

Supposing that flow-in current of 20 μA is fed as a reference, the relation between the amount of adhered toner and the surface potential (toner layer potential) of toner particles of the liquid developer will be considered below.

Using FIG. 7, the relation between the toner layer potential and the amount of adhered toner with the changing flow-in current will now be described.

Figure 7:
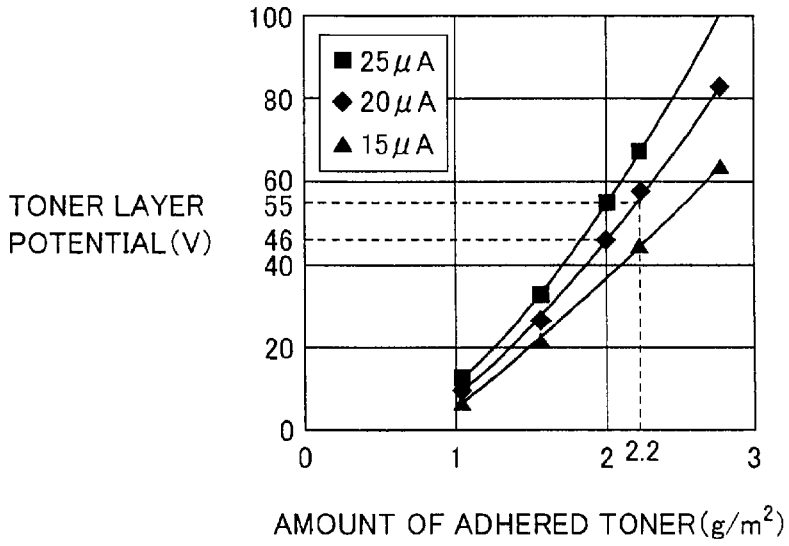
FIG. 7 is a graph illustrating the relation between a toner layer potential and the amount of adhered toner in a case where flow-in current is changed.

As shown in FIG. 7, shown here is the system on the assumption that the flow-in current of 20 μA is fed as a reference. The system with the flow-in current changed ±5 μA is also shown.

Here, when the amount of adhered toner, that is, the toner layer thickness is 2 g/m$^2$, the surface potential (toner layer potential) of 46 V was observed with the flow-in current of 20 μA.

On the other hand, with the flow-in current of 25 μA, the surface potential (toner layer potential) of 55 V was observed.

Given that the flow-in current at that time is 20 μA, the amount of adhered toner is calculated as 2.2 g/m$^2$. Thus, the calculation result of the amount of adhered toner has an error.

The embodiment of the present invention calculates the amount of adhered toner according to the rate of change of the surface potential (toner layer potential), rather than calculating the toner layer thickness, that is, the amount of adhered toner by measuring the flow-in current to developing roller 24.

FIG. 6 shows that the surface potential (toner layer potential) linearly changes according to the flow-in current from charger 27 to developing roller 24. It can be understood that the slope of change as shown here varies according to the amount of adhered toner. Specifically, the larger is the amount of adhered toner, the greater is the slope of change, whereas the smaller is the amount of adhered toner, the smaller is the slope of change.

Using FIG. 8, a graph showing the rate of change of the surface potential (toner layer potential) on the vertical axis and the amount of adhered toner on the horizontal axis will be described, based on the relation in FIG. 6.

Figure 8:
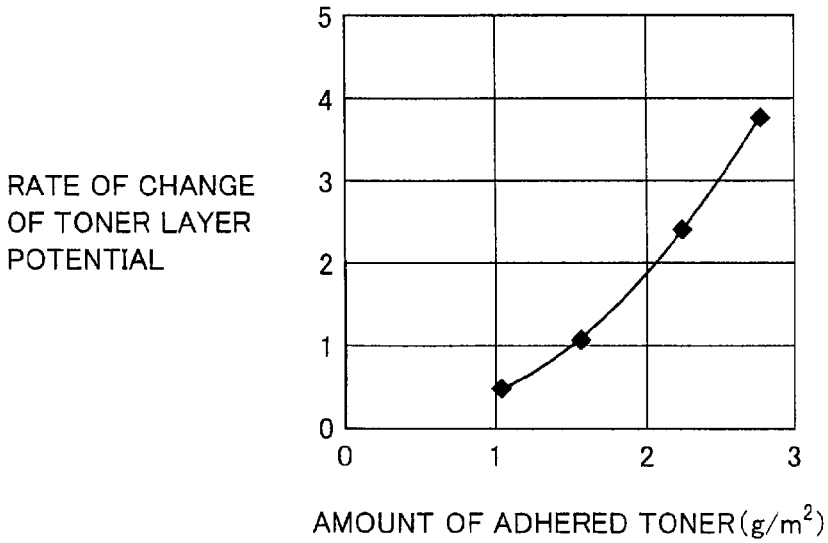
FIG. 8 is a graph showing a change rate of surface potential (toner layer potential) on the vertical axis and the amount of adhered toner on the horizontal axis, based on the relation in FIG. 6.

As shown in FIG. 8, if the rate of change of the surface potential (toner layer potential) is known, the amount of adhered toner that is the toner layer thickness can be calculated.

In the actual system, it is difficult to measure the exact value of current flowing into developing roller 24. However, it is possible to accurately output a plurality of currents, namely, a reference current, a current 1.5 times larger, a current 2.0 times larger, etc. from high-voltage power supply 64 for charger 27. In such a case, the ratio of current flowing into developing roller 24 from charger 27 is approximately the same as the ratio of output current from the high-voltage power supply. Based on the rate of change of that current and the value of surface potential (toner layer potential) for each output value, it is possible to calculate the rate of change of the surface potential (toner layer potential) with respect to the flow-in current.

Then, it is possible to calculate the amount of adhered toner from the rate of change of toner layer potential using FIG. 8, and to calculate the amount of adhered toner precisely without measuring the exact current value of flow-in current actually flowing into developing roller 24.

Using FIG. 9, a flow of controlling the thickness of the toner layer according to the first embodiment of the present invention will be described. The processing in CPU 50 will be mainly described.

Figure 9:
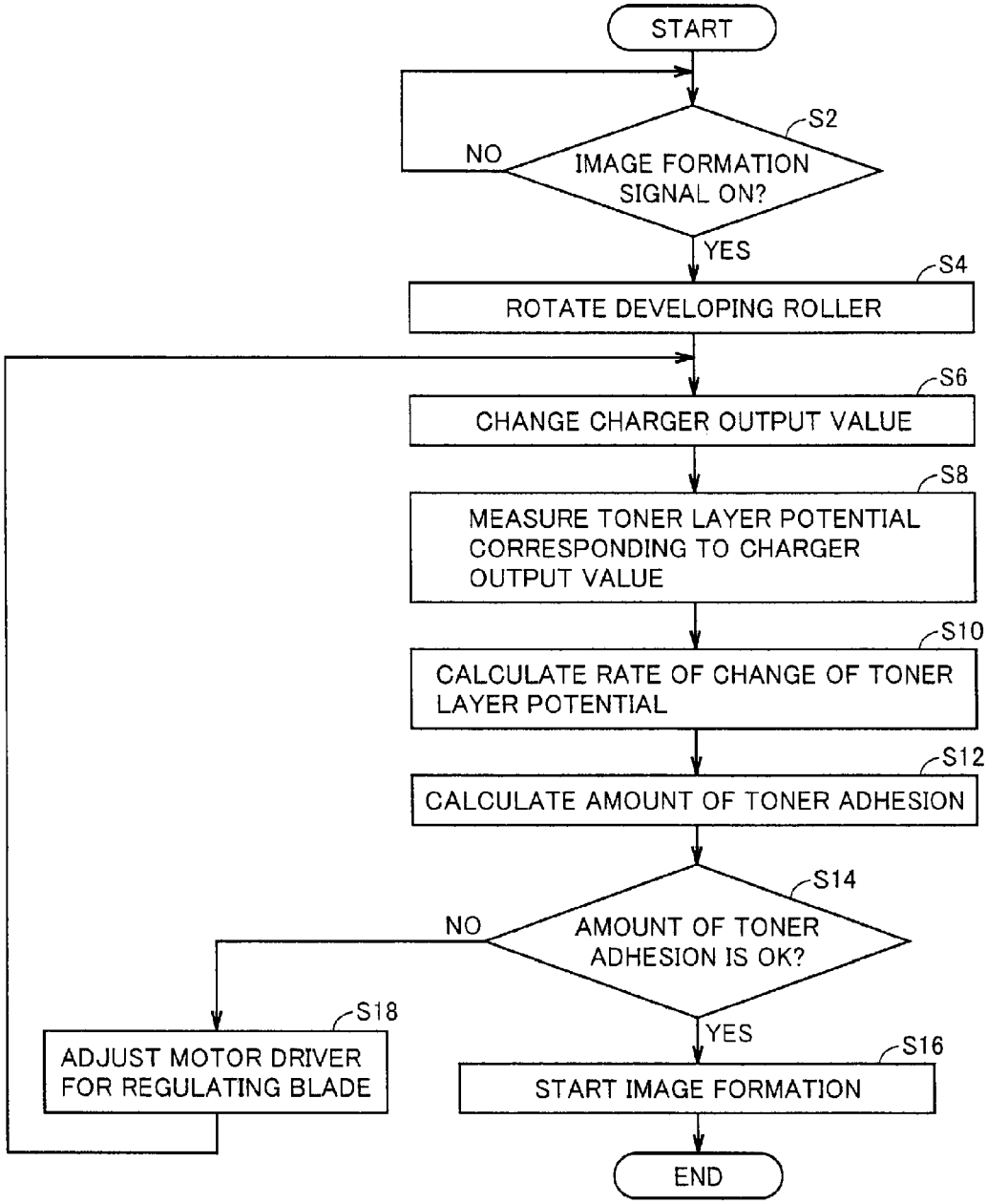
FIG. 9 is a flowchart for controlling the thickness of the toner layer according to the first embodiment of the present invention.

Referring to FIG. 9, first, it is determined whether an image formation signal is ON (step S2). Specifically, CPU 50 determines whether execution of image forming is designated through user's operation on the operation panel. If execution of image formation is designated through user's operation on operation panel 60, CPU 50 determines that the image formation signal is ON, and then proceeds to the next step.

Then, the developing roller is rotated (step S4). Specifically, CPU 50 gives an instruction to motor driver 56. Motor driver 56 rotates drive motor 58 according to the instruction from CPU 50. Developing roller 24 rotates at a prescribed speed, accordingly, so that a thin layer of liquid developer is formed on developing roller 24.

Then, the output value of current to charger 26 is changed (step S6). CPU 50 gives an instruction to output control device 62, and output control device 62 then instructs high-voltage power supply 64 on the current value from the high-voltage power supply to be output to charger 26, according to the instruction from CPU 50. In this example, output control device 62 instructs high-voltage power supply 64 to gradually increase the value of current output from high-voltage power supply 64 to charger 26 from the initial value, by way of example. The value of current output from high-voltage power supply 64 to charger 26 can be changed by changing the output voltage from high-voltage power supply 64.

Then, the surface potential (toner layer potential) corresponding to the output value to charger 26 is measured (step S8).

Current is fed from high-voltage power supply 64 to charger 26 to cause current to flow from charger 26 onto developing roller 24. The toner particles in liquid developer 6 on developing roller 24 are charged by this current.

The output value of current flowing in charger 26 from high-voltage power supply 64 is changed, and the toner layer potential which changes according to the change of the output value of current is measured. The surface potential (toner layer potential) of the charged toner particles is measured by surface potential sensor 28.

Next, CPU 50 calculates the rate of change of the toner layer potential based on the measurement results (step S10). Specifically, the result of measurement by surface potential sensor 28 is changed by changing the value of current flowing from the high-voltage power supply for charger 26, and then, the rate of change (slope) of the toner layer potential is calculated based on the results.

Next, CPU 50 calculates the amount of adhered toner (step S12). Specifically, the amount of adhered toner is calculated from the rate of change of the toner layer potential, based on the graph in FIG. 8.

Then, CPU 50 determines whether the amount of adhered toner is OK (step S14). Specifically, it is determined whether the amount of adhered toner reaches a prescribed defined value. The defined value may not be a fixed value but instead a certain margin may be provided, so that if the amount of adhered toner falls within the range, it may be determined that the amount of adhered toner is OK. When the amount of adhered toner is varied according to the paper type or the like, a plurality of defined values of the amount of adhered toner are provided. In this case, control may be performed such that the amount of adhered toner reaches each of those values.

If it is determined that the amount of adhered toner is OK in step S14 (YES in step S14), the process proceeds to the next step to start image formation (step S16).

The process then ends (END).

On the other hand, if it is determined that the amount of adhered toner is not OK in step S14 (NO in step S14), the process proceeds to step S18.

In step S18, adjustment of motor driver 52 is executed (step S18). Specifically, CPU 50 instructs motor driver 52 to control the amount of blade pressure. Motor driver 52 adjusts drive motor 54 according to the instruction from CPU 50 and changes the amount of pressure against developing roller 24.

Then, the process returns to step S6, and the similar process is repeated.

More specifically, in step S14, the process above is repeated until the amount of adhered toner is OK.

Using FIG. 10, the relation between the amount of liquid developer on the developing roller and the amount of blade pressure will be described. Here, the amount of pressure refers to the distance of pressing toward the center of developing roller 24 with respect to the tangent of the developing roller at the contact point between developing roller 24 and regulating member 3 in FIG. 3.

Figure 10:
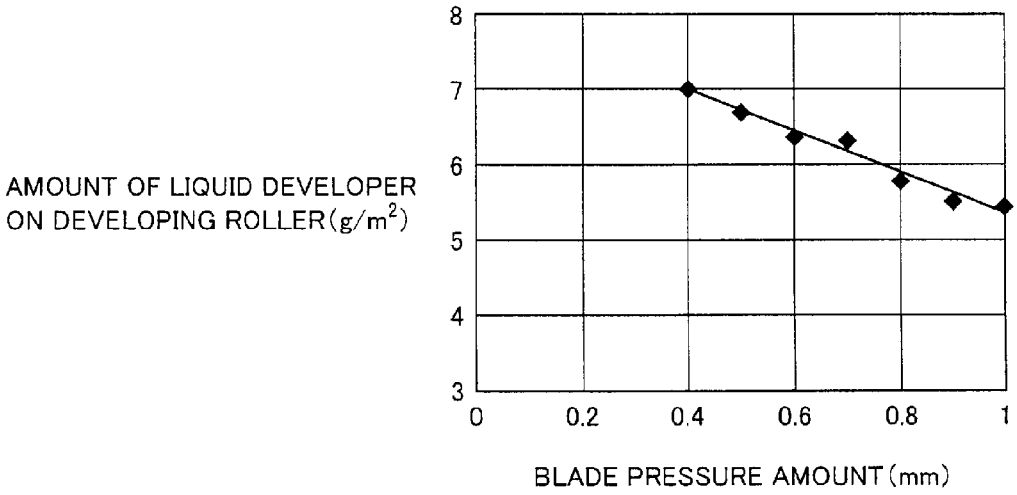
FIG. 10 is a graph illustrating the relation between the amount of liquid developer on a developing roller and the amount of blade pressure.

Referring to FIG. 10, the amount of liquid developer on the developing roller can be reduced as the amount of blade pressure increases.

Motor driver 52 adjusts the amount of pressure by the blade, that is the regulating member, by adjusting drive motor 54 according to an instruction from CPU 50. For example, when it is determined that the amount of adhered toner is not OK, and when it is determined that the calculated amount of toner adhesion is larger than a prescribed value serving as a reference, adjustment is made such that the amount of blade pressure is increased. On the other hand, when it is determined that the amount of adhered toner is not OK, and when it is determined that the calculated amount of toner adhesion is smaller than a prescribed value serving as a reference, adjustment is made such that the amount of blade pressure is reduced.

In the adjustment of the amount of blade pressure, motor driver 52 may make adjustment such that the amount of blade pressure attains an appropriate value according to the difference between the calculated amount of toner adhesion and the prescribed value serving as a reference. Alternatively, motor driver 52 may make adjustment such that the amount of blade pressure is changed by every prescribed value.

Through this process, the toner layer thickness, that is, the amount of adhered toner, can be adjusted accurately and properly, without measuring the flow-in current.

In this example, the toner density is 30%, and the amount of adhered toner per 1 $g/m^2$ of liquid developer is 0.3 $g/m^2$, by way of example.

In this example, the toner layer thickness is adjusted by calculating the amount of adhered toner before image formation when the image formation signal is ON, by way of example. However, the adjustment may be performed at the time when the wet-type image forming apparatus is started up, after a certain number of sheets are printed after the start of printing, after a prescribed period passes since the adjustment, or at an interval between print images.

Second Embodiment

In the foregoing first embodiment, the layer thickness of liquid developer 6 on developing roller 24 is controlled by the amount of pressure (pressure-contact force) by the blade that is the regulating member. In the present second embodiment, a supply member is provided to supply liquid developer to developing roller 24, and the layer thickness is controlled by controlling the supply member.

Using FIG. 11, a configuration of a developing device according to the second embodiment will be described.

Figure 11:
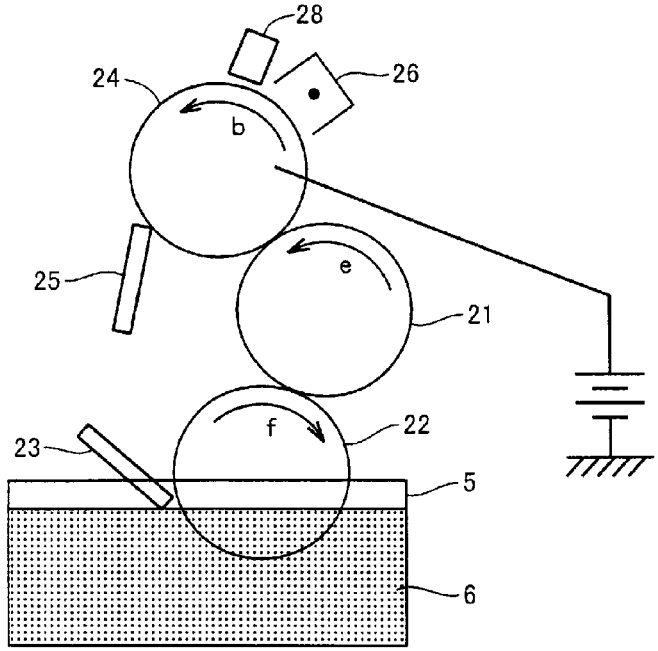
FIG. 11 illustrates a configuration of a developing device according to a second embodiment of the present invention.

Referring to FIG. 11, the developing device according to the second embodiment of the present invention differs from the developing device in the first embodiment in that a supply roller 21 and a pump-up roller 22 are further provided.

Liquid developer 6 is stored in developer tank 5, and pump-up roller 22 is provided so as to be partially soaked in the stored liquid developer 6.

Liquid developer 6 is pumped up with rotation of pump-up roller 22 in the f direction. A regulating member 23 regulates the amount of liquid developer 6 to be pumped up to a certain fixed amount. A metal roller (anilox roller) having depressions on its surface may be used as pump-up roller 22 so that the amount of liquid developer can be stabilized more.

After regulating member 23 regulates the amount of liquid developer 6 to be pumped up, pump-up roller 22 comes into abutment with supply roller 21 to pass liquid developer 6 to supply roller 21. Drive motor 58 rotates supply roller 21 in the e direction in the figure, which is opposite to the rotation direction of developing roller 24, and motor driver 56 changes the rotational speed. In this example, supply roller 21 is driven by drive motor 58. Motor driver 56 rotates drive motor 58 at a prescribed speed according to an instruction from CPU 50.

Rotation of pump-up roller 22 follows that of supply roller 21 and has its rotational speed changed according to the rotational speed of supply roller 21. When the rotation of supply roller 21 is accelerated in this state, the amount of liquid developer to be supplied to developing roller 24 is increased. Conversely, when the rotation is slowed down, the amount of liquid developer 6 to be supplied to developing roller 24 is reduced. Thus, the amount of liquid developer 6 to be supplied to developing roller 24 can be controlled.

Using FIG. 12, the relation between the amount of liquid developer on the developing roller and the rotational speed of the supply roller will be described.

Figure 12:
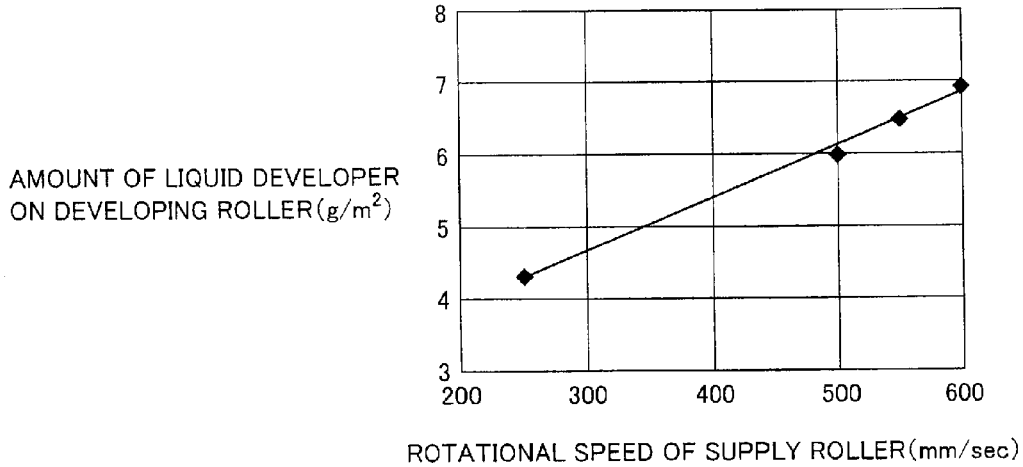
FIG. 12 is a graph illustrating the amount of liquid developer on a developing roller and the rotational speed of a supply roller.

As shown in FIG. 12, the amount of liquid developer on the developing roller can be increased as the rotational speed of the supply roller increases. On the other hand, the amount of liquid developer on the developing roller can be reduced as the rotational speed of the supply roller decreases.

In the second embodiment, the rotational speed of the supply roller is adjusted based on the relation shown in FIG. 12, rather than adjusting the motor driver, in step S18 in the flowchart in FIG. 9.

Specifically, when it is determined that the amount of adhered toner is not OK in step S14 in the flowchart in FIG. 9, and when it is determined that the calculated amount of toner adhesion is larger than the prescribed amount serving as a reference, the rotational speed of the supply roller is adjusted to slow down, by way of example.

On the other hand, when it is determined that the amount of adhered toner is not OK, and when it is determined that the calculated amount of toner adhesion is smaller than the prescribed value serving as a reference, the rotational speed of the supply roller is adjusted to speed up. The adjustment is performed by motor driver 56 controlling driving of drive motor 58 according to an instruction from CPU 50.

Through this process, the toner layer thickness, that is, the amount of adhered toner, can also be adjusted accurately and properly, without measuring the flow-in current to developing roller 24.

In this example, the toner density is 30%, and the amount of adhered toner per 1 $g/m^2$ of liquid developer is 0.3 $g/m^2$, by way of example.

Third Embodiment

In the foregoing description, the layer thickness of liquid developer on the developing roller (the amount of thin layer) is adjusted for high-quality image formation. In addition, images of higher quality can be formed by maintaining the toner charge amount within a proper range.

If the toner charge amount is high, all the toner on developing roller 24 is not developed on photoconductor 1. As a result, the amount of toner on the photoconductor may be reduced, and an image at a constant density cannot be obtained. On the other hand, if the toner charge amount is low, fogging or image noise may occur.

In the third embodiment of the present invention, the toner charge amount as well as the toner layer thickness is adjusted within a proper range.

Using FIG. 13, the relation between the flow-in current to developing roller 24 and the toner charge amount according to the third embodiment of the present invention will be described.

Figure 13:
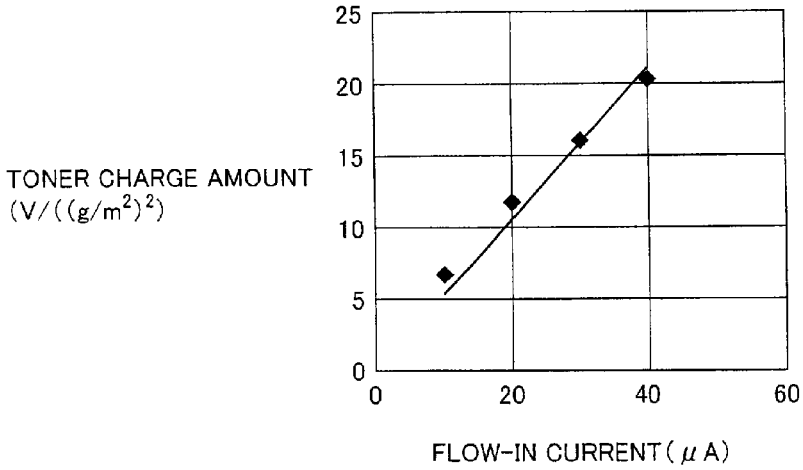
FIG. 13 is a graph illustrating the relation between flow-in current and the toner charge amount according to a third embodiment of the present invention.

Referring to FIG. 13, shown is the case where the toner charge amount increases according to the flow-in current. Here, the relation between the flow-in current and the toner charge amount in a case where the amount of adhered toner is 2.2 $g/m^2$ is shown. The toner charge amount is calculated based on the surface potential/(the amount of adhered toner)$^2$. Specifically, it is calculated based on the relation between the toner layer potential and the flow-in current shown in FIG. 6.

In the case of any other amount of toner adhesion, the toner charge amount can be calculated similarly.

The toner charge amount on developing roller 24 is determined by the value of current flowing into developing roller 24 from charger 26. In other words, the toner charge amount can be controlled by adjusting the flow-in current from charger 26 to developing roller 24 to a proper value.

Using FIG. 14, a flow of controlling the thickness of the toner layer and the toner charge amount according to the third embodiment of the present invention will be described. The processing in CPU 50 will be mainly described.

Figure 14:
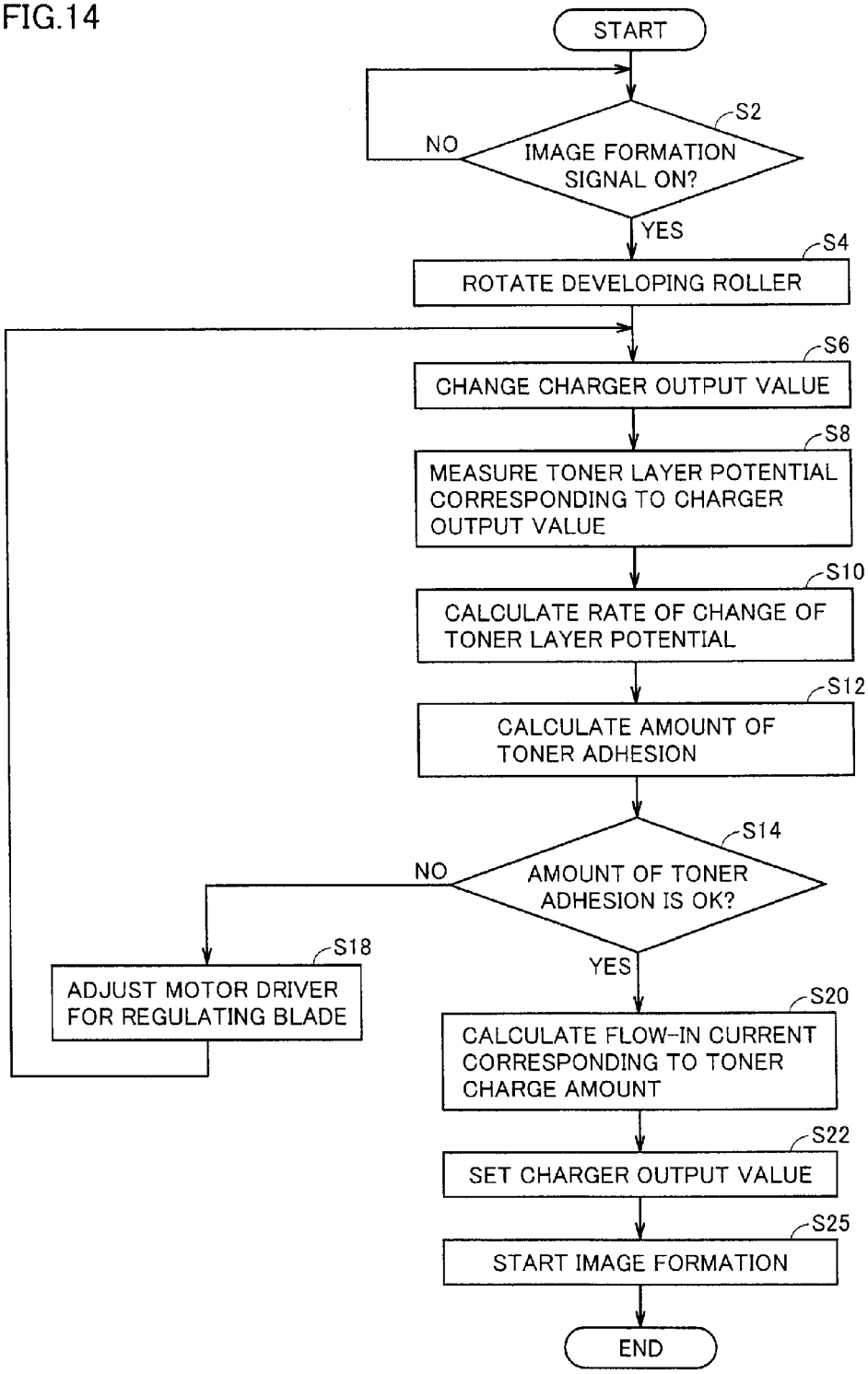
FIG. 14 is a flowchart for controlling the thickness of the toner layer and the toner charge amount according to the third embodiment of the present invention.

Referring to FIG. 14, when compared with the flowchart in FIG. 9, a process of controlling the toner charge amount is further executed after step S14.

Specifically, after step S14, the flow-in current corresponding to the toner charge amount is calculated (step S20). Specifically, the graph in FIG. 13 is used to calculate the flow-in current corresponding to the proper toner charge amount. For example, when the toner charge amount is adjusted to 20 $V/((g/m^2))$ using the graph in FIG. 13, the flow-in current should be set to 40 μA.

Next, the output value to charger 26 is set (step S22).

Using FIG. 15, the relation between the power supply output to charger 26 and the flow-in current will be described.

Figure 15:
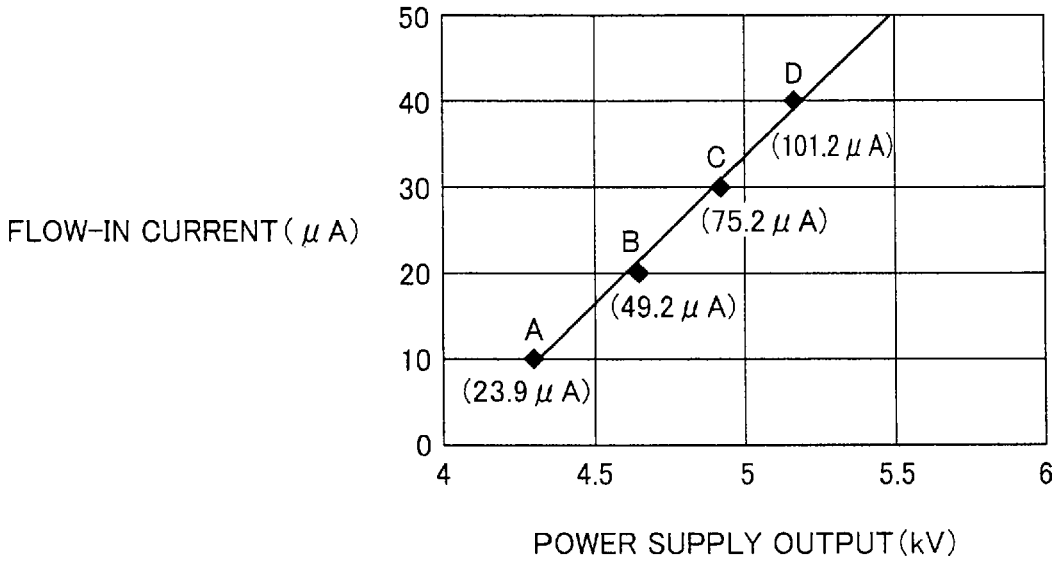
FIG. 15 is a graph illustrating the relation between a power supply output to a charger 26 and flow-in current.

Referring to FIG. 15, shown is the case where the flow-in current linearly changes as the power supply output increases. Using this relation, the power supply output (output value) is set such that the flow-in current attains a proper value.

Thus, the charge amount of liquid developer can be controlled to a proper value by adjusting the flow-in current from charger 26 to developing roller 24 to a proper value.

The process then proceeds to the next step to start image formation (step S25).

The process then ends (END).

Modification of Third Embodiment

Using FIG. 16, a flow of controlling the thickness of the toner layer and the toner charge amount according to a modification of the third embodiment will be described. The processing in CPU 50 will be mainly described.

Figure 16:
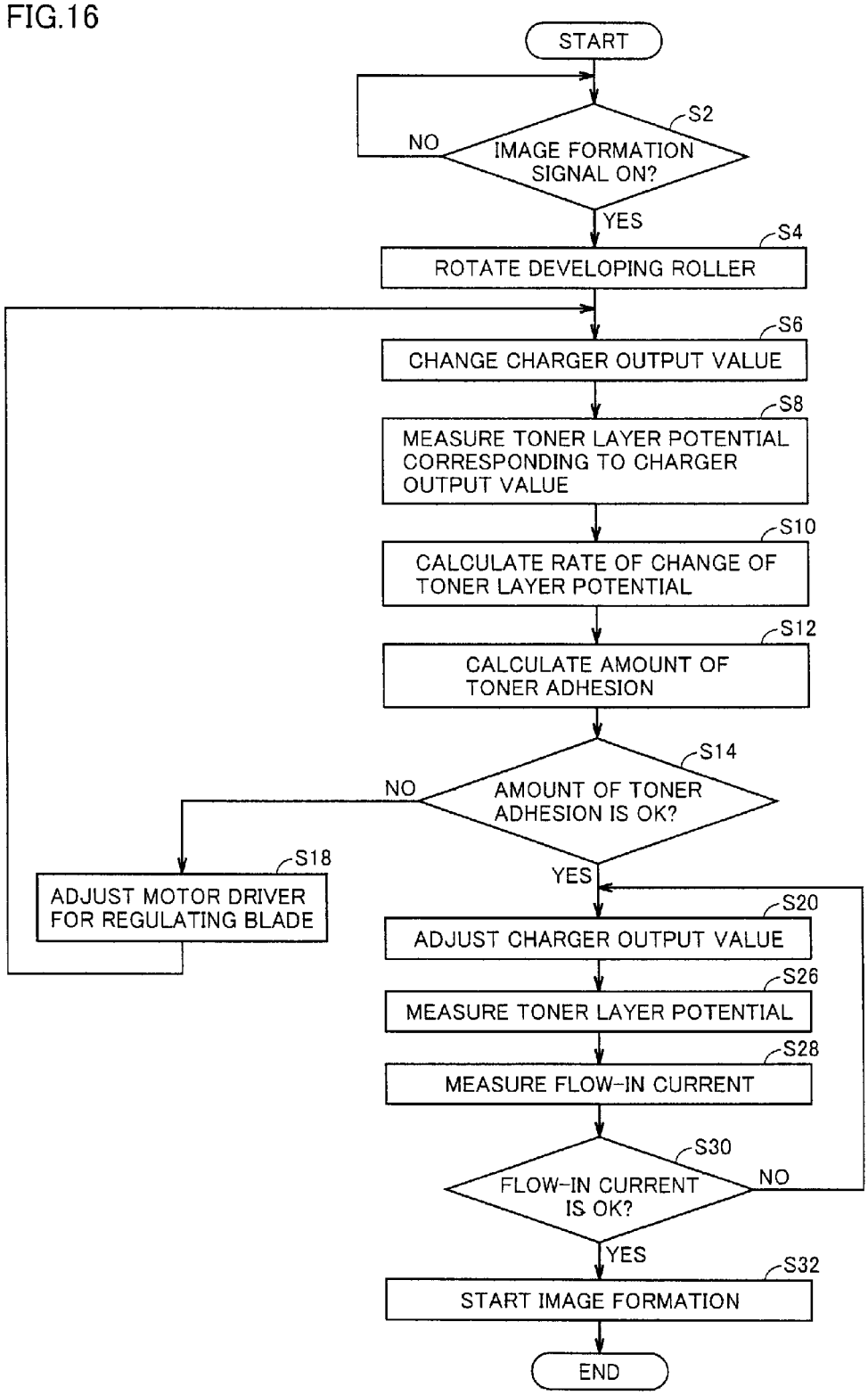
FIG. 16 is a flowchart for controlling the thickness of the toner layer and the toner charge amount according to a modification of the third embodiment of the present invention.

Referring to FIG. 16, when compared with the flowchart in FIG. 9, a process of controlling the toner charge amount is further executed after step S14.

Specifically, after step S14, the output value to the charger is adjusted (step S20). Specifically, a prescribed value (initial value) is set as the output value to the charger, by way of example.

Next, the toner layer potential is measured (step S26). Specifically, the surface potential of the charged toner particles (toner layer potential) is measured by surface potential sensor 28.

Next, the flow-in current is calculated (step S28). CPU 50 calculates the flow-in current based on the amount of adhered toner and the toner layer potential, using the graph in FIG. 6.

Then, it is determined whether the flow-in current is OK (step S30). CPU 50 determines whether the calculated flow-in current becomes the desired flow-in current. The desired value of the flow-in current can be obtained from the value of the flow-in current corresponding to the desired toner charge amount, using the graph in FIG. 13.

If it is determined that the flow-in current is OK in step S30 (YES in step S30), the process proceeds to the next step to start image formation (step S32). The desired value of the flow-in current may not be a fixed value but instead, a certain margin may be provided, so that if the value falls within that range, it may be determined that the flow-in current is OK.

On the other hand, if it is determined that the flow-in current is not OK in step S30 (NO in step S30), the process returns to step S20, and the output value to the charger is adjusted again. Specifically, if the value of the flow-in current is smaller than the desired value of the flow-in current, the output value is increased. If the value of the flow-in current is greater than the desired value of the flow-in current, the output value is reduced. The output value is thus finely adjusted. Then, the toner layer potential is measured, the flow-in current is calculated, and this process is repeated until the flow-in current attains the optimum value.

Then, image formation is started with the optimum value of the flow-in current.

Through this process, the charge amount of liquid developer can also be controlled to a proper value by setting the flow-in current to the optimum value.

In the flow above, after the toner layer potential is measured in step S26, the flow-in current corresponding to the toner layer potential is calculated in step S28, and it is determined whether the toner charge amount corresponding to the flow-in current becomes the desired charge amount in step S30. If it does not, the process returns to step S20 to adjust the output value to the charger. On the other hand, as the toner layer potential is measured in step S26, the toner charge amount can be directly calculated based on the surface potential/(the amount of adhered toner)$^2$ as described above. Therefore, at the moment when the toner layer potential is measured, the toner charge amount may be calculated and it may be determined whether the calculated toner charge amount becomes the desired charge amount. If it does not, the process returns to step S20 to adjust the output value to the charger.

Although the present invention has been described and illustrated in detail, it is clearly understood that the drawings and preferred embodiments are made by way of illustration and example only and are not to be taken by way of limitation, the scope of the present invention being interpreted by the terms of the appended claims.

What is claimed is:

1. A wet-type image forming apparatus which forms a toner image on an image carrier using liquid developer containing carrier liquid and toner dispersed therein, comprising:

a developing member configured to carry the liquid developer to develop a latent image thereby forming the toner image on the image carrier;

a charger configured to charge the liquid developer on the developing member according to a current applied on the charger;

a measuring member configured to measure an electric potential of the liquid developer charged by the charger; and a controller configured to control an amount of the liquid developer on the developing member, before the toner image is formed on the image carrier, by setting plural values of the current to be applied on the charger and controlling the amount of the liquid developer based on results of measurement by the measuring member of electric potentials of the liquid developer charged by the charger with the plural values of the current applied on the charger.

2. The wet-type image forming apparatus of claim 1, wherein the controller is configured to calculate a rate of change of the electric potential of the liquid developer based on results of measurement by the measuring member, and to adjust the amount of the liquid developer based on the calculated rate of change of the electric potential of the liquid developer.

3. The wet-type image forming apparatus of claim 2, wherein the controller is configured to estimate an amount of the liquid developer on the developing member, and to adjust an amount of the liquid developer based on the estimated amount of the liquid developer.

4. The wet-type image forming apparatus of claim 3, further comprising a memory configured to store therein data of amounts of the liquid developer corresponding to rates of change of the electric potential of the liquid developer on the developing member, wherein the controller is configured to estimate the amount of the liquid developer based on the calculated rate of change of the electric potential of the liquid developer and the data in the memory.

5. The wet-type image forming apparatus of claim 3, wherein the amount of the liquid developer on the developing member estimated by the controller is determined without measuring an exact current flowing into the developing member.

6. The wet-type image forming apparatus of claim 2, wherein the rate of change of the electric potential of the liquid developer calculated by the controller is with respect to the current applied on the charger.

7. The wet-type image forming apparatus of claim 1, wherein the controller is configured to set a value of the current to be applied on the charger at a time of forming the toner image based on the results of measurement by the measuring member.

8. The wet-type image forming apparatus of claim 1, further comprising a regulating member configured to regulate the amount of the liquid developer on the developing member by pushing itself against the liquid developer on the developing member, wherein the controller controls an amount of pressure by the regulating member based on the results of measurement by the measuring member.

9. The wet-type image forming apparatus of claim 1, further comprising a supply member configured to supply the liquid developer by coming into contact with the developing member, wherein the controller controls a rotating speed of the supply member based on the results of measurement by the measuring member.

* * * * *